US005084991A

United States Patent [19]

Cronk, Jr.

[11] Patent Number: 5,084,991

[45] Date of Patent: Feb. 4, 1992

[54] PIPELINE PADDING APPARATUS AND METHOD

[76] Inventor: Thomas J. Cronk, Jr., P.O. Box 11189, Odessa, Tex. 79760

[21] Appl. No.: 579,077

[22] Filed: Sep. 6, 1990

[51] Int. Cl.[5] ..... E02F 5/22; B07B 1/22; B07B 1/42

[52] U.S. Cl. ..... 37/142.5; 209/235; 209/241; 209/257; 209/285; 209/288; 209/406; 209/421; 405/179; 37/195

[58] Field of Search ..... 209/235, 240, 241, 243, 209/247-249, 255, 257, 284, 285, 288, 393, 406, 420, 421; 37/142.5, 195; 171/14, 15, 46, 111, 112, 123, 124, 129, 136, 139; 172/32, 118, 119, 122, 554; 405/179

[56] References Cited

U.S. PATENT DOCUMENTS

| | | | |
|---|---|---|---|
| 41,283 | 1/1864 | DeGroot | 171/129 |
| 1,004,715 | 10/1911 | Valiquett et al. | 37/189 |
| 1,220,197 | 3/1917 | Cowles | 209/285 X |
| 1,658,398 | 2/1928 | Seaman | 37/189 |
| 1,860,481 | 5/1932 | Royer . | |
| 2,553,072 | 5/1951 | Zeh et al. | 209/285 X |
| 2,744,739 | 5/1956 | Evans et al. | 171/129 |
| 2,814,387 | 11/1957 | McWilliams . | |
| 2,857,691 | 10/1958 | Curran | 37/142.5 X |
| 2,947,096 | 8/1960 | Cummings et al. | 37/142.5 X |
| 2,974,795 | 3/1961 | Behnke et al. . | |
| 3,314,175 | 4/1967 | Petty et al. . | |
| 3,365,050 | 1/1968 | Taylor . | |
| 3,396,481 | 8/1968 | Hovorak . | |
| 3,596,384 | 8/1971 | Neujahr . | |
| 3,701,422 | 10/1972 | Downey | 209/241 |
| 3,860,291 | 1/1975 | Rauch et al. . | |
| 3,981,089 | 9/1976 | Burrows . | |
| 4,057,917 | 11/1977 | Burrows . | |
| 4,221,505 | 9/1980 | Taylor-Smith . | |
| 4,301,910 | 11/1981 | Price . | |
| 4,377,365 | 3/1983 | Layh . | |
| 4,633,602 | 1/1987 | Layh et al. . | |
| 4,861,461 | 8/1989 | Utterback . | |
| 4,912,862 | 4/1990 | Bishop et al. | 37/142.5 |
| 4,948,299 | 8/1990 | Cronk, Jr. et al. . | |

FOREIGN PATENT DOCUMENTS

| | | | |
|---|---|---|---|
| 0856905 | 8/1940 | France | 209/285 |
| 1142601 | 2/1985 | U.S.S.R. | 37/142.5 |

*Primary Examiner*—Michael S. Huppert
*Assistant Examiner*—Edward M. Wacyra
*Attorney, Agent, or Firm*—Vaden, Eickenroht Thompson & Boulware

[57] ABSTRACT

A method and apparatus are disclosed for padding a pipeline lying in a ditch by separating fine particles from coarse particles in the material excavated from the ditch and windrowed along the side of the ditch comprising moving a frame supporting a rotating separator drum at the desired distance above ground to engage windrowed material at the level required to obtain sufficient fines to pad the pipeline while rotating the separating drum to separate the fine and coarse material and conveying the fines laterally into the ditch.

13 Claims, 4 Drawing Sheets

PIPELINE PADDING APPARATUS AND METHOD

FIELD OF THE INVENTION

This invention relates generally to earth and material handling equipment and a method of operating the equipment. More particularly, it relates to improved method of and apparatus for separating a windrow of excavated material alongside a ditch into fine particles of dirt hereinafter "fines" and coarse particles that include clods and large rocks hereinafter "coarse particles" and depositing the fines into the ditch and the coarse material back onto the windrow of excavated material.

BACKGROUND OF THE INVENTION

Cross country pipelines are usually coated with a corrosion-resistant substance. To protect the coating from damage when the ditch is back filled with excavated material, which may contain large rocks, the pipeline is first covered with fine particles of dirt to serve as a protective padding around the pipeline.

U.S. Pat. Nos. 2,857,691, 3,701,422, 4,633,602, 4,861,461 and 4,948,299 relate to apparatus that is moved with or by a vehicle along the side of the ditch for collecting and separating a windrow of excavated material into fine material and coarse material and conveying the fines into the ditch to cover the pipeline and returning the coarse material to the windrow on the ground.

The most pertinent of these patents is U.S. Pat. No. 2,857,691, which issued Oct. 28, 1958 to Donald Michael Curran, and is entitled "Pipeline Ditch Filling and Pipe Padding Machine". This patent discloses the use of a rotating head to separate the excavated material into fine material and coarse material and a conveyor to carry the fines to the ditch. The head and an auger extend laterally from a tractor on one side of the ditch to the windrow of excavated material on the other side of the ditch. The conveyor and the drum are supported in the vertical plane by a flexible cable attached to a boom on the tractor. Therefore, Curran's rotating head cannot be held in a fixed horizontal position. As a result it will remove continuously varying amounts of excavated material requiring the operator to constantly vary the speed and direction of the tractor and the amount of the total weight of the head and the conveyor that is allowed to force the head against the excavated material.

Therefore, it is an object of this invention to provide a method and apparatus for padding a pipeline that includes a rotating drum for separating the fine and coarse particles of the previously excavated material that is mounted on the front of a tractor and is held against vertical movement as the rotating drum is forced through the excavated material at a selected depth to produce a continuous stream of fines for padding the pipeline.

It is a further object of this invention to provide an apparatus for padding a pipeline from either side of the apparatus.

It is a further object of this invention to provide a pipeline padding apparatus that includes a frame for attaching to the front end of a tractor for movement through a windrow of excavated material along the side of the ditch as the tractor moves over the windrow of material, a hollow drum rotatably mounted on the frame having spaced rods for separating fine material from coarse material, means rotatable with the head for lifting a portion of the excavated material upwardly with the drum as the drum rotates causing the material to fall against the rods so the fine material falls between the rods into the drum and the coarse material is carried on the rods and deposited behind the drum back onto the remaining windrow of excavated material extending along the side of the ditch under the moving tractor, and a conveyor that extends through the drum and the sides of the frame to receive the fines and deposit them onto the pipeline in the ditch.

BRIEF DESCRIPTION OF THE DRAWINGS

Other advantages and features of the invention will become more apparent with reference to the following detailed description of a presently preferred embodiment thereof in connection with the accompanying drawings, wherein like reference numerals have been applied to like elements, in which.

DETAIELD DESCRIPTION

Figure 1:
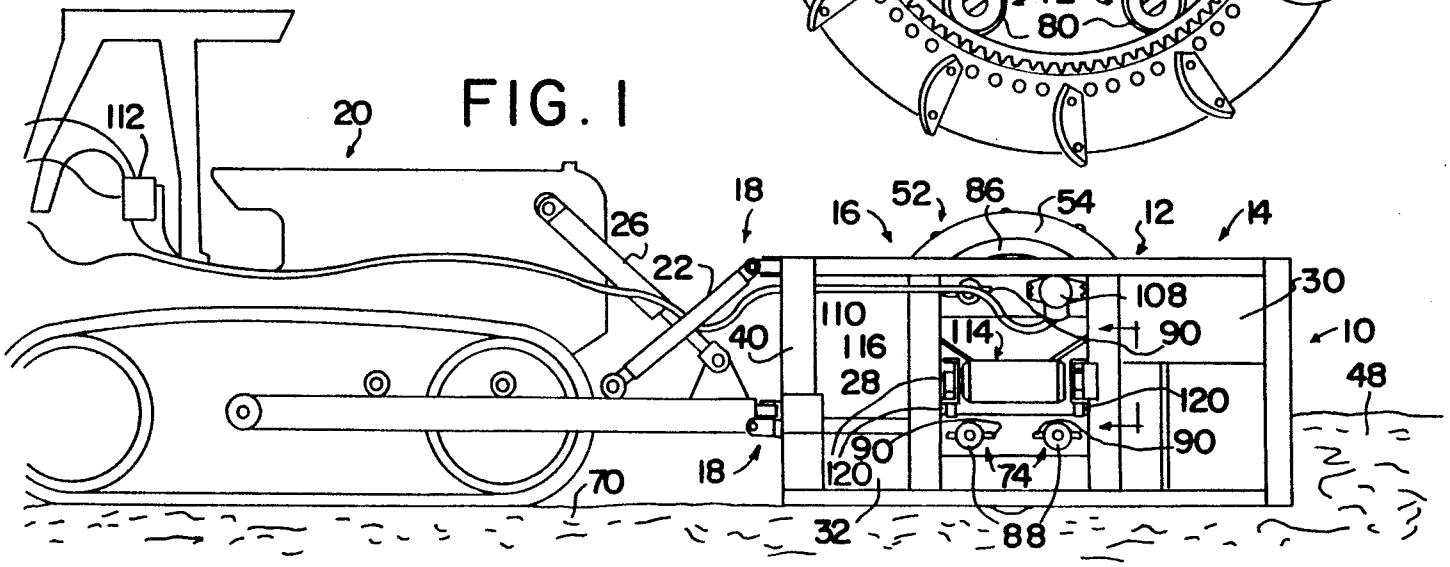
FIG. 1 is a simplified side elevational view of pipe padding apparatus constructed in accordance with the present invention.
Figures 2, 8:
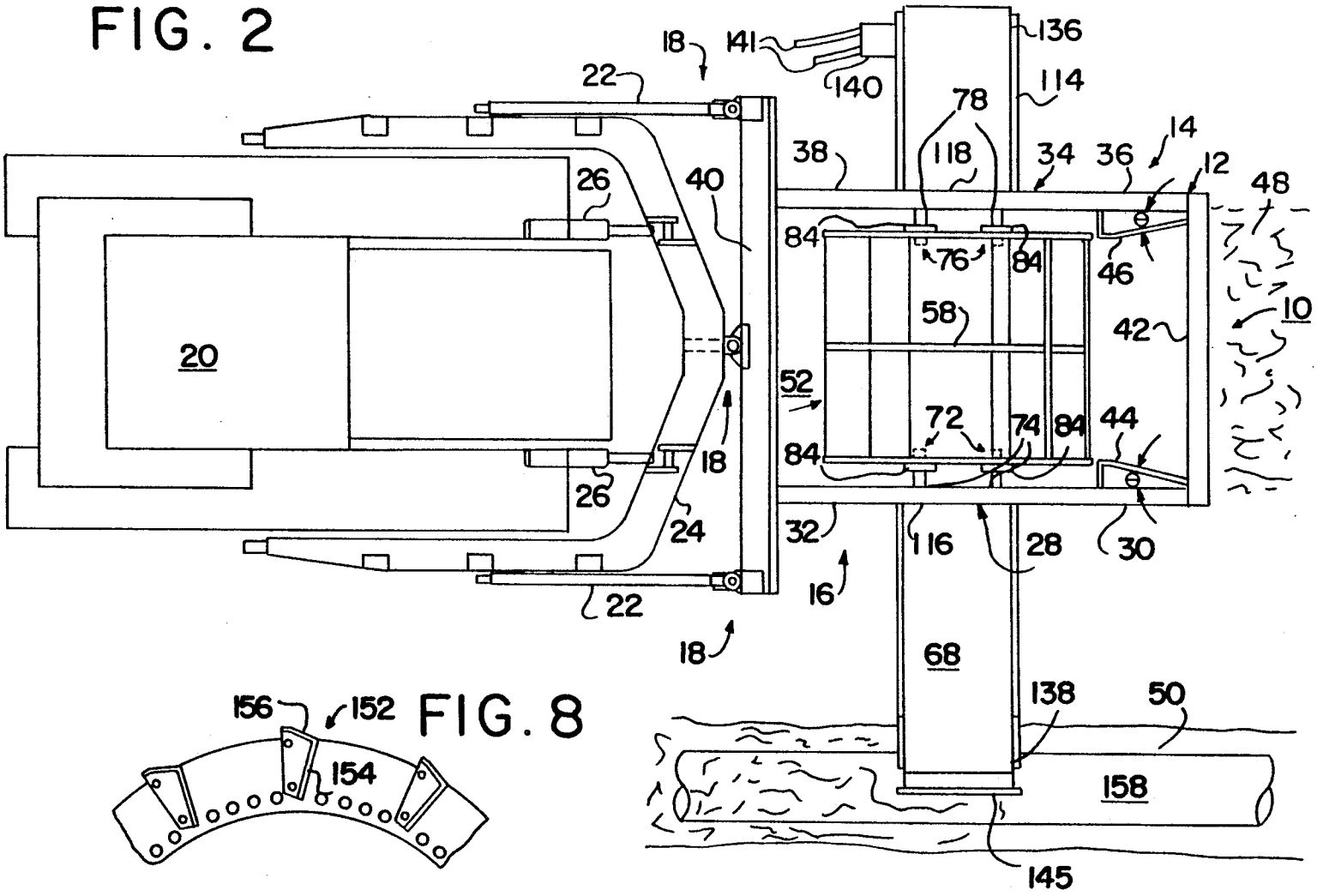
FIG. 2 is a simplified top plan view of the apparatus.
FIG. 8 is an elevational view of an alternate embodiment of the apparatus of this invention.

Referring to the drawings and FIGS. 1 and 2 in particular, the pipe padding apparatus 10 comprises a generally box-shaped frame 12 having front portion 14 and rear portion 16. The rear portion 16 includes mounting means 18 to align with and attach to a tractor or bulldozer 20 at the same three attachment points as used to attach a blade (not shown) to a tractor or bulldozer 20. Mounting means 18 include adjustable mounting bars 22 attached between the generally box-shaped frame 12 and the forwardly extending yoke 24 of bulldozer 20. Tractor 20 is equipped with conventional yoke 24 that is elevated and lowered by piston and cylinder assemblies 26 through the conventional hydraulic system of tractor or prime mover 20.

The generally box-shaped frame 12 comprises a first side frame member 28 in the general form of a rectangular panel having a front end portion 30 and a rear end portion 32, and a second side frame member 34 in the general form of a rectangular panel generally parallel to the first side frame member and having a front end portion 36 and a rear end portion 38. A rear end frame member 40, in the general form of a rectangular panel generally perpendicular to and attached between first side frame member 28 and second side frame member 34 at rear end portions 32 and 38 and extending outwardly past the first and second side frame members 28 and 34. In the preferred embodiment, mounting means 18 is attached to rear end frame member 40. A front end frame member 42 is attached between first side frame member 28 and second side frame member 34 at front end portions 30 and 36. Its front end is open to receive the excavated material as it is moved thereover.

First guide means 44 projects inwardly from first side frame member 28 and second guide means 46 projects inwardly from second side frame member 34 to guide a portion of the excavated material 48 inwardly toward hollow drum 52, which is rotatably mounted in the generally box-shaped frame 12. In the preferred embodiment, first guide means 44 and second guide means 46 comprise generally rectangular-shaped panels attached to the front end portions 30 and 36 that extend rearwardly at an angle away from the first and second side frame members 28 and 34 and toward the outer sides of hollow separating drum 52.

Figure 4:
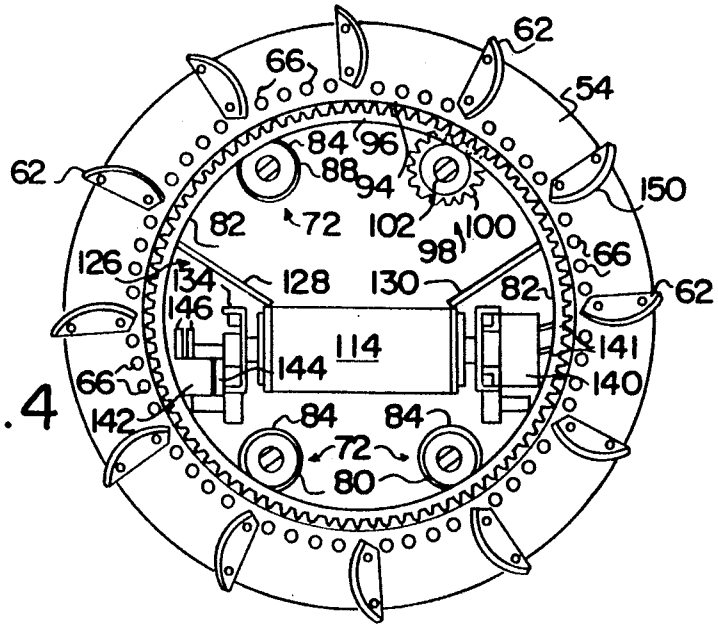
FIG. 4 is a cross-sectional view of the separating drum taken along lines 4—4 of FIG. 3 and showing the conveyor located in working relationship with the drum.
Figure 3:
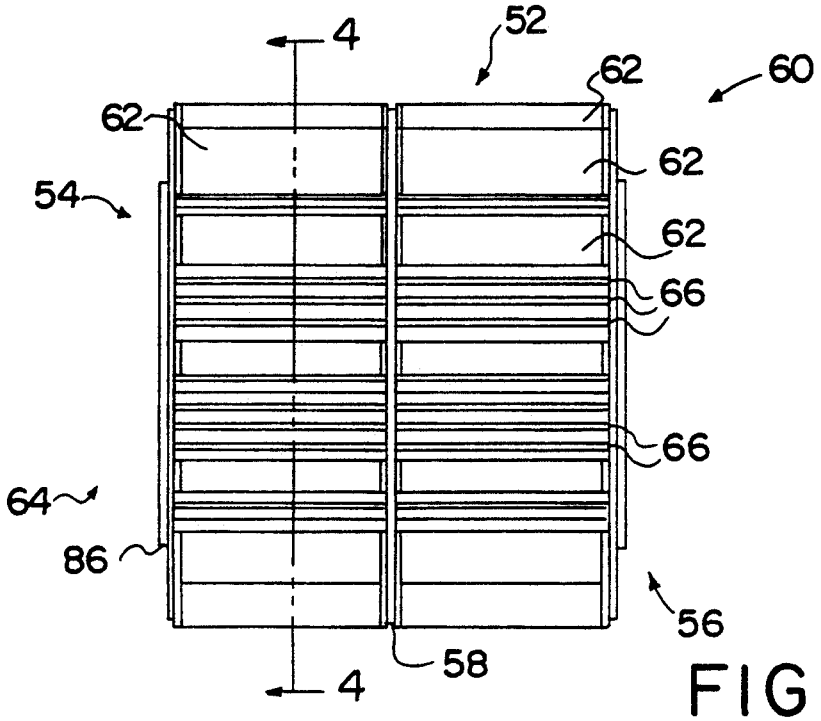
FIG. 3 is a front elevational view of the separating drum of the apparatus.

With reference to FIGS. 3 and 4, separating drum 52 comprises first outside ring member 54, second outside ring member 56 and center ring member 58. Earth elevating means 60 are circumferentially spaced about the periphery of the hollow drum 52 and are attached between the center ring member 58 and the outside ring members 54 and 56. In the preferred embodiment, the earth elevating means 60 comprises spaced apart, arcuate scoop members 62 for lifting excavated material 48 as the rotating drum is pushed through the windrow of material.

A plurality of elongated parallel rods 66 are spaced around and attached to the circumference of center ring member 58 and outside ring members 54 and 56. In the disclosed embodiment, four elongated rods 66 are shown between adjacent arcuate scoop members 62, but it will be appreciated that the size and numbers of rods 66 as well as the spacing therebetween can vary. The rods perform a separating function by allowing fines 68 to fall into the drum 52 while keeping the residue of coarse or larger particles on the outer periphery of the head so that the residue will fall off the back side thereof. In one embodiment of the apparatus the rods were spaced 1½" apart.

With reference to FIGS. 1, 2, 4 and 5*a*–5*b*, first rollers 72 are attached to first side frame member 28 by first mounting means 74, and second rollers 76 are attached to second side frame member by second mounting means 78. Each of the rollers 72 includes an annular periphery surface 80 that contacts and supports the inner periphery 82 of first outside ring member 54, and a rectangular raised portion or shoulder 84 extending radially outwardly from said annular periphery surface 80 to bear against side surface 86 of first outside ring member 54 to maintain first outside ring member 54 a predetermined distance from first side frame member 28. Each of the rollers 76 are the same or similar to the rollers 72 and support the inner periphery of second outside ring member 56 in a similar manner. Hollow drum 52 is thereby held in position for rotation between the first and second side frame members.

First mounting means 74 includes fastening means 88 and slotted apertures 90 formed in first side frame member 28. In the preferred embodiment, fastening means 88 comprises a bolt and nut with the bolt positioned through elongated aperture 90 and aperture 92 of the roller 72. Elongated apertures 90 allow the rollers 72 and 76 to be moved with respect to the drum 52 and thus allow adjustment for any wear that occurs. Second mounting means 78 is the same as first mounting means 74 and support the second rollers 76.

At least one of the first and second outside ring members 54 and 56 includes a drive ring or gearwheel 94 with drive teeth 96 formed on the inner periphery thereof. At least one of the rollers is structured to not only rotatably support drum 52 but also has drive teeth 100 to mate with teeth 96 and thus rotate the drum. Drive member 98 is keyed to shaft 102 which is driven by power means 104. Surface !06 of drive member 98 bears against side surface 86 of first outside ring member 54. In the preferred embodiment, power means 104 comprises a reversible hydraulic motor 108, which is provided with hoses 110 and control box 112 for the operation and control thereof from within the tractor.

In the preferred embodiment, both the first outside ring member 54 and the second outside ring member 56 include a drive ring 94 with drive teeth 96 which mesh with a drive member 98. Shaft 102 is connected to and drives both drive members 98. Reversible hydraulic motor 108 may be mounted to either first side frame member 28 or second side frame member 34 and may be connected to either end of shaft 102.

A transfer or transverse conveyor 114 extends through the hollow drum as well as through aperture or cutout 116 formed in first side frame member 28 and a similar aperture or cutout 118 in second side frame member 34. Transfer or transverse conveyor 114 is operatively mounted to first and second side frame members 28 and 34 by mounting means 120. In operation, fines 68 fall between rods 66 onto the moving conveyor belt. The fines are guided onto the conveyor by funnel means 128 comprising front guide plate 130 and rear guide plate 132, which extend between first and second outside ring members 54 and 56 and are attached to frame 134 of transfer conveyor 114. The conveyor 124 is supported along its length by rollers (not shown) mounted in frame 134. End rollers 136 and 138 serve as longitudinal limits for the conveyor belt.

Figure 7:
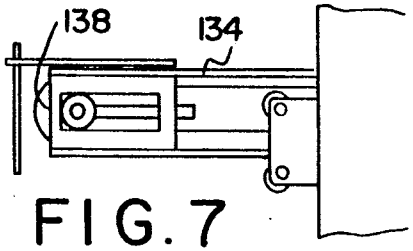
FIG. 7 is a side elevational view of a portion of the conveyor.

In the disclosed embodiment, end roller 136 is rotated by reversible hydraulic motor 140 to move conveyor belt 122 in either direction such that the fines 68 may be discharged from either side of the generally box-shaped frame 12. Reversible hydraulic motor 140 is connected to control box 112 by lines 141. Stop member 145 (see FIGS. 2 and 7) is attached to the end of frame 124 and provides a back stop for fines 68 as they leave conveyor belt 122 so the fines will fall directly down onto pipeline 158.

Transfer or transverse conveyor 114 is moved laterally of the drum 52 by reversible hydraulic motor 142 and rack and pinion mechanism 144 connected between frame 134 and reversible hydraulic motor 140. Lines 146 connect reversible hydraulic motor to control box 112.

A solid shield 148 is disposed internally of hollow drum 52 and provides a peripheral wall extending throughout a predetermined arc about the axis of rotation of drum 52 to maintain the excavated material 48 at the front portion 14 of generally box-shaped frame 12 so the excavated material 48 may be lifted up by scoops 62. Shield 148 extends between first outside ring member 54 and second outside ring member 56 and connects with the upper edge of front guide plate 130 and extends downwardly for at least forty-five degrees (45°) from its upper edge. Shield 148 may be attached to either first and second side frame members 28 and 34 or to frame 134 of transfer or transverse conveyor 114.

The preferred embodiment of the arcuate scoop members 62 comprises a curved scoop portion 150 formed on a radius of six inches and extending over an arc of one hundred and fifteen degrees (115°). An alternate embodiment shown in FIG. 8 comprises a scoop portion 152 comprising long flat portion 154 and short flat portion 156 positioned at ninety ( degrees (90°) to the long flat portion 154.

Figure 9:
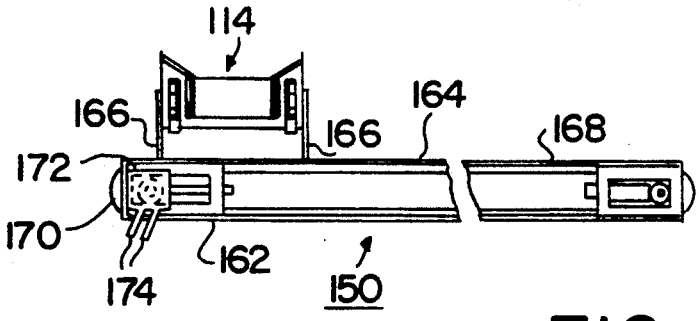
FIG. 9 is a side elevational view of a forward transfer conveyor at the end of the conveyor within the drum.
Figures 5A, 5B:
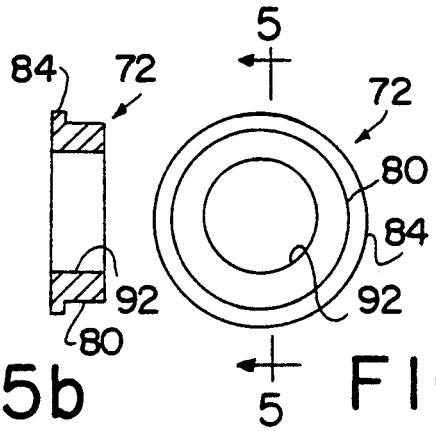
FIG. 5*a* is an elevational view of supporting apparatus for the drum.
FIG. 5*b* is a cross-sectional view taken along line 5—5 of FIG. 5*a;*
Figures 6A, 6B:
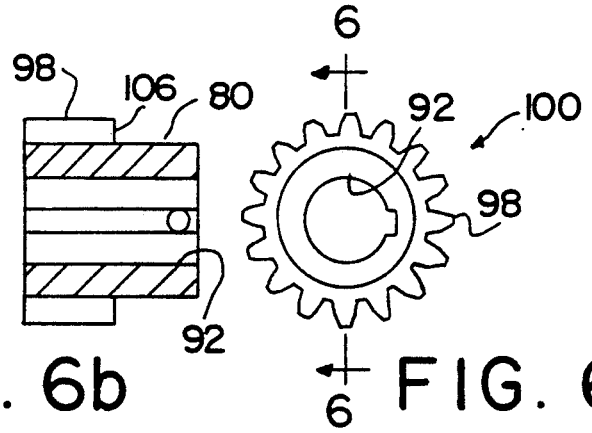
FIG. 6*a* is an elevational view of drive apparatus for the head.
FIG. 6*b* is a cross-sectional view taken along line 6—6 of FIG. 6*a;*

An additional embodiment of the present invention (see FIG. 9) includes a forward transfer conveyor 160 that is positioned generally parallel to the first and second side frame members 18 and 34 with a first or entrance end 162 under the discharge end of transfer or transverse conveyor 114 to receive the fines 68 therefrom and transfer them forwardly and into ditch 50 onto the pipe or pipeline 158 at a position forward of the generally box-shaped frame 12. The frame 164 of the forward transfer conveyor 160 is attached to frame 134 of transfer or transverse conveyor 114 by attachments 166 to move toward and away from the ditch 50 with the transfer or transverse conveyor 114. The belt 168 is approximately eighteen inches in width. End roller 170 is powered by hydraulic motor 172 and is connected to control box 112 by lines 174. The forward transfer conveyor 160 is especially useful when the excavated material 48 contains a great number of rocks or large chunks of hard earth that might be dislodged by the front portion 14 of the generally box-shaped frame 12 and could then fall into ditch 50 and damage the protective coating on the pipeline 158. The forward transfer conveyor 160 discharges the fines 68 onto the pipe or pipeline 158 ahead of the generally box-shaped frame 12 so that if rocks are dislodged they will fall on the fines 68 covering the pipeline 158 and not fall directly onto the pipeline 158.

In the disclosed embodiment, the frame 12 is approximately ten (10') feet long, five feet (5') high and seven feet (7') wide with the rear end frame member 40 being approximately twelve feet (12') wide. The hollow drum 52 is approximately six feet (6') in diameter. The transfer or transverse conveyor 114 is approximately sixteen feet (16') in length and has a belt which is twenty-four inches (24") in width. It will be appreciated that these dimensions are only exemplary and do not limit the spirit and scope of the invention as disclosed.

In operation, the bulldozer or tractor 20 and the attached pipe padding apparatus 10 are aligned such that the row of excavated material 48 along the side of the ditch 50 is generally centered between the first and second side frame members 28 and 34. The frame 12 is positioned vertically with respect to the row of excavated material 48 so that a desired portion of excavated material 48 is lifted by the earth elevating means 60. The counterclockwise rotation (as viewed in FIG. 1) of the hollow head 52 is initiated by activating hydraulic motor 108. The transverse conveyor 114 is started by activating hydraulic motor 140. The end of the transverse conveyor 114 is positioned over the pipe or pipeline 158 in ditch 50. The bulldozer 20 is moved forward at the desired speed while the first and second guide means 44 and 46 guide the excavated material 48 into the open front end of the frame and toward hollow drum 52 while shield 148 maintains the excavated material 48 at the forward portion of the drum 52 so the scoops can lift the excavated material 48 upwardly. As the material is carried upwardly, the fines will fall between the rods into the drum and onto the laterally extending conveyor to be carried to the ditch and dumped on the pipe in the ditch. The coarse material will be dumped behind the drum. The rear frame member serves to prevent coarse material from being flung against the front of the tractor, but is sufficiently open at its lower end to permit the residue to fall onto the excavated material 48 that was not lifted upwardly.

The amount of fines 68 that are deposited on the pipe or pipeline 158 in ditch 50 may be varied by 1) varying the speed of the bulldozer 20 along the ditch 50, 2) the speed of rotation of the hollow drum 42, 3) the height of the generally box-shaped frame 12 with respect to the row of excavated material, and 4) the speed of the transfer conveyor.

From the foregoing detailed description, it can be appreciated that a pipe padding apparatus constructed in accordance with this invention provides an improved pipe padding machine which is less complicated than the prior art and is less expensive. It is more easily transported from job-to-job. The prime mover may be used for other functions when the pipe padding apparatus is not being used.

Although the present invention has been described with reference to a presently preferred embodiment, it will be appreciated by those skilled in the art that various modifications, alternatives, variations, etc., may be made without departing from the spirit and scope of the invention as defined in the appended claims.

What is claimed is:

1. Pipe padding apparatus, comprising a box-like frame adapted to be moved along a row of excavated material along the side of a ditch in which a pipeline has been laid by a vehicle traveling along the same side of the ditch, said frame having side walls with openings therein and an open front to receive at least a portion of the excavated material as the frame is moved therealong, a generally cylindrically shaped, open ended, hollow drum, means supporting the drum between and from the side walls of the frame for rotation about an axis transverse to the row of excavated material, means for rotating the drum to cause the bottom thereof to move in the direction of travel of the frame, said drum having means thereabout for lifting excavated material which is received through said open front as the drum is so rotated, and means for screening coarse particles from the fines within the material which is lifted to the top of the drum and allowing the fines to fall into the hollow drum, and conveyor means mounted on the frame and extending in a direction generally parallel to the axis of rotation of the drum and through the open ends of the drum and the openings in the side walls of the frame so as to receive the fines as they fall into the drum and convey them into the ditch, said frame having a rear end which is open at least at the bottom portion thereof to permit the coarse particles to pass therethrough.

2. Apparatus of the character defined in claim 1, wherein the drum includes rings at its ends, and said screening means comprises rods which extend between and are connected to the rings to form slots between them about the outer periphery of the drum.

3. Apparatus of the character defined in claim 2, wherein the drum has at least one intermediate ring, and said rods extend between the end rings and said at least one intermediate ring and are connected to the at least one intermediate ring.

4. Apparatus of the character defined in claim 1, wherein said drum includes rings at each end, said screening means is supported by and extends between the rings about the outer periphery of the drum, and said drum supporting means comprises rods which extend through the open ends of the drum and extend between and are mounted on the side walls of the frame, and rollers mounted on the ends of the rods and supporting the rings for rotation.

5. Apparatus of the character defined in claim 4, wherein said drum rotating means comprises gear teeth about at least one ring, and a pinion on at least one of said rollers for driving the gear teeth.

6. Apparatus of the character defined in claim 1, wherein the conveyor means includes a conveyor frame mounted on and extending between the side walls of the box-like frame, and an endless belt mounted on the conveyor frame.

7. Apparatus of the character defined in claim 6, including means on the box-like frame for shifting the conveyor frame in opposite directions generally parallel to the axis of the drum.

8. Apparatus of the character defined in claim 6, including means mounted on the conveyor frame and extending through the open ends of the drum in position to guide fines which fall through the screening means onto the belt.

9. Apparatus of the character defined in claim 1, wherein said drum comprises rings at its ends, and said lifting means comprises shovels which are mounted on and extend between the rings.

10. Apparatus of the character defined in claim 1, including means mounted on the frame conveying from positions adjacent the open front towards the ends of the drum for guiding material into the drum as it is received through the open front of the frame.

11. Apparatus of the character defined in claim 1, including a shield mounted on the frame and extending between the side walls thereof and curved to fit closely within the forward portion of the interior of the drum and from near the lower portion thereof to a height above the conveyor means.

12. Apparatus of the character defined in claim 1, including additional conveyor means mounted on the frame outwardly of one side wall thereof in position to recieve material from one end of the conveyor means and move it forwardly for deposit in the ditch forwardly of the open front of the frame.

13. Apparatus of the character defined in claim 1, including means by which the frame may be raised or lowered with respect to the vehicle.

* * * * *